US010130554B2

(12) United States Patent
Aronson

(10) Patent No.: US 10,130,554 B2
(45) Date of Patent: Nov. 20, 2018

(54) SYSTEM FOR THERAPEUTIC TREATMENT BY VACUUM PRESSURE AND METHOD OF USE THEREOF

(71) Applicant: Robert Aronson, Winfield, WV (US)

(72) Inventor: Robert Aronson, Winfield, WV (US)

(73) Assignee: Robert George Aronson, Winfield, WV (US)

( * ) Notice: Subject to any disclaimer, the term of this patent is extended or adjusted under 35 U.S.C. 154(b) by 711 days.

(21) Appl. No.: 14/602,048

(22) Filed: Jan. 21, 2015

(65) Prior Publication Data

US 2015/0202115 A1 Jul. 23, 2015

Related U.S. Application Data

(60) Provisional application No. 61/929,745, filed on Jan. 21, 2014.

(51) Int. Cl.

*A61H 33/00* (2006.01)
*A61H 9/00* (2006.01)
*A61H 33/02* (2006.01)

(52) U.S. Cl.

CPC ..... *A61H 33/6089* (2013.01); *A61H 9/0078* (2013.01); *A61H 33/0087* (2013.01); *A61H 33/02* (2013.01); *A61H 2201/0157* (2013.01); *A61H 2201/0207* (2013.01); *A61H 2201/0214* (2013.01); *A61H 2201/0257* (2013.01); *A61H 2201/164* (2013.01); *A61H 2201/165* (2013.01); *A61H 2201/1619* (2013.01);

(Continued)

(58) Field of Classification Search

CPC .. A61H 33/6089; A61H 9/0078; A61H 33/02; A61H 2201/0157; A61H 2201/0207; A61H 2201/0214; A61H 2201/0257; A61H 2201/1619; A61H 33/0087; A61H 2201/1635; A61H 2201/164; A61H 2201/165; A61H 2201/5071; A61H 2201/5097; A61H 2209/00; A61H 2201/1628

See application file for complete search history.

(56) References Cited

U.S. PATENT DOCUMENTS 4,353,359 A * 10/1982 Milbauer ..... A61G 10/005 601/166
4,421,109 A * 12/1983 Thornton ..... A61H 9/005 600/20

(Continued)

*Primary Examiner* — Steven Douglas
(74) *Attorney, Agent, or Firm* — The Webb Law Firm

(57) ABSTRACT

A therapeutic device for applying pressure to a portion of a wearer's body is provided. The device includes a flexible enclosure formed from a flexible material and configured to enclose at least a portion of the wearer's body, thereby forming a cavity between an inner surface of the enclosure and the body. The device also includes at least one port extending through the flexible enclosure for accessing the cavity; and a fluid evacuation pump in fluid communication with the cavity. The device is configured such that, upon actuation of the pump, the flexible enclosure transitions from a relaxed position to a compressed position, in which the flexible enclosure exerts a compression force against the wearer's body. Optionally, the flexible enclosure defines a cross sectional area, wherein the cross sectional area in the relaxed position is greater than the cross sectional area in the compressed position.

18 Claims, 4 Drawing Sheets

(52) U.S. Cl.
CPC ..... *A61H 2201/1628* (2013.01); *A61H 2201/1635* (2013.01); *A61H 2201/5071* (2013.01); *A61H 2201/5097* (2013.01); *A61H 2209/00* (2013.01)

(56) References Cited

U.S. PATENT DOCUMENTS

| | | | | |
|---|---|---|---|---|
| 4,772,259 | A * | 9/1988 | Frech | A61H 33/14 604/23 |
| 4,989,589 | A * | 2/1991 | Pekanmaki | A61H 9/0078 601/150 |
| 5,938,626 | A * | 8/1999 | Sugerman | A61B 17/42 600/561 |
| 7,384,379 | B2 | 6/2008 | Egger | |
| 7,705,500 | B2 | 4/2010 | Mills et al. | |
| 8,100,887 | B2 * | 1/2012 | Weston | A61M 1/0088 604/313 |
| 2013/0204169 | A1 * | 8/2013 | Poepperling | A61H 9/0078 601/46 |

* cited by examiner

SYSTEM FOR THERAPEUTIC TREATMENT BY VACUUM PRESSURE AND METHOD OF USE THEREOF

CROSS REFERENCE TO RELATED APPLICATION

This application claims priority to U.S. Provisional Application No. 61/929,745, filed on Jan. 21, 2014, the disclosure of which is incorporated herein by reference in its entirety.

BACKGROUND OF THE INVENTION

Field of the Invention

This disclosure relates, in general, to devices and methods for therapeutic treatment of an individual to improve cardiac, pulmonary, and muscle function, and, more particularly, to devices and methods for applying compression or pressure to a wearer's body with an air evacuation or vacuum pump.

Description of the Related Art

Applying pressure and thermal energy to areas of the human body are common methods for treating muscle injuries and chronic pain. Pressure is known to encourage healing by improving blood flow and circulation, as well by providing support for injured muscle tissue. Most simply, compressive garments, sleeves, braces, and wraps are used to protect pulled muscles, relieve pain, and to prevent further injury. However, sleeves and wraps only provide limited compressive force. Specifically, compressive force is limited based on the elasticity of the sleeve or garment or by how tightly a wrap or bandage is wound about the affected body region. Additionally, the more compressive force the garment provides, the more difficult it is to put on and take off. Furthermore, compressive garments are most useful for treatment of extremities (e.g., legs and arms) and are generally not suitable for simultaneous treatment of multiple body regions. Further still, over time, the sleeve or wrap becomes loose, reducing the compressive force being provided. Additionally, wraps and sleeves are incapable of providing pulsating or varying force, which would provide additional pain relief.

Systems and devices for applying pressure by massaging muscular tissue are also well known. Massage devices typically include a vibrating mechanism, such as an electric motor, enclosed within a sleeve or rigid housing. Pressing the enclosure or housing against a portion of the patient's body transfers the vibrational force to the body, thereby providing treatment for sore muscle tissue. An exemplary vibration apparatus for enhanced vibrational massage therapy is disclosed in U.S. Pat. No. 7,705,500. Vibration mechanisms may by inserted into or provided with compressive sleeves for simultaneous compression and massage-type treatment.

Negative vacuum pressure systems have also been created to treat body tissue, to improve tissue function or appearance, and/or to reduce pain. These systems generally provide a negative-pressure chamber that encloses about a portion of the body. Application of negative pressure improves circulation and blood flow through regions of the body. In certain versions of the systems, a user wears a negative-pressure suit or enclosure during physical activity to encourage blood flow to specific body regions. Increasing blood flow during exercise has numerous therapeutic benefits, including increasing metabolic rate, which increases the metabolization of fat tissue in the target body region.

Negative pressure systems and devices typically comprise an airtight or approximately air tight flexible clothing article wrapped about a portion of a user's body. The article is attached to a vacuum pump for evacuating air from the cavity between the clothing article and the user's skin. The systems also include a support layer or structure for preventing the outer layer (e.g., the clothing article) from collapsing around the patient as air is evacuated from the cavity. In this way, a cavity between the clothing article and body region having a negative pressure is formed. An exemplary negative-pressure fitness device is discussed in U.S. Pat. No. 7,384,379. However, such a system does not provide compression or support for injured tissue and, as such, does not provide certain desirable therapeutic results.

The devices and systems described above do not provide sufficient compressive or pulsating pressure against the body to achieve certain desirable therapeutic results. Particularly, these devices and systems do not provide enough pressure or compressive force to treat cardiovascular, pulmonary, skeletal, and muscle systems of a patient's body. Additionally, the above-described devices and systems are often difficult to put on and take off, making it more difficult to achieve desired therapeutic results. Therefore, a need exists for improved devices and systems for providing a consistent compressive force to a patient to improve body function.

SUMMARY OF THE INVENTION

According to one aspect of the invention, a therapeutic device for applying pressure to a portion of a wearer's body is provided. The device includes a flexible enclosure formed from a flexible material and configured to enclose at least a portion of the wearer's body, thereby forming a cavity between an inner surface of the enclosure and the body. The device also includes at least one port extending through the flexible enclosure for accessing the cavity; and a fluid evacuation pump in fluid communication with the cavity. The device is configured such that, upon actuation of the pump, the flexible enclosure transitions from a relaxed position to a compressed position, in which the flexible enclosure exerts a compression force against the wearer's body. In some embodiments, the device is configured such that at least a portion of the flexible enclosure defines a cross sectional area and wherein the cross sectional area in the relaxed position is greater than the cross sectional area in the compressed position.

In certain embodiments, the flexible enclosure comprises a body suit having a central portion configured to receive the wearer's torso and outer portions configured to receive the wearer's extremities. The port of the flexible enclosure may also include a releasable connector configured to engage an end of a hose extending between the port and the pump. The releasable connector comprises a luer lock connector, a snap fit connector, a threaded connector, a one-way valve, or any combination thereof.

In certain embodiments, the therapeutic device further comprises a controller associated with the fluid evacuation pump. The controller is configured to automatically actuate and stop operation of the pump. Optionally, the controller may also be configured to automatically increase or decrease a suction force of the fluid evacuation pump. For example, the controller may be configured to adjust the suction force according to an operating routine stored in computer readable memory associated with the controller. In some embodiments, the therapeutic device also includes at least one sensor configured to measure an operating parameter of the therapeutic device, the parameter being one or more of:

a compression force of the flexible enclosure against the wearer's body, an air pressure within the cavity, a flow rate of fluid being removed from the cavity, a physical parameter of the wearer, or any combination thereof. The controller may be configured to adjust a suction force of the pump based at least in part on one or more of the operating parameters. Finally, the controller may be configured to repeatedly perform an operating routine a predetermined number of times. The operating routine comprises the following steps: activating the fluid evacuation pump, adjusting a suction force of the air evacuation pump, and stopping operation of the air evacuation pump.

In certain embodiments of the therapeutic device, the flexible enclosure includes at least one collar extending around a portion of the flexible enclosure for preventing the enclosure from sliding along the wearer's body as the flexible enclosure transitions from the relaxed position to the compressed position. The therapeutic device may also include at least one shield comprising a rigid frame positioned between the inner surface of the flexible enclosure and the wearer's body. The shield is configured to prevent a portion of the flexible enclosure from compressing against a portion of the patient's body. Optionally, the shield is arranged to cover one or more of a cardiothoracic region, an abdomen region, head, feet, or toes of the wearer's body.

In certain embodiments, the flexible enclosure comprises a bag having a closed bottom and sides, and a re-sealable closure defining an opening sized to be placed over at least a portion of the wearer's body. Optionally, the re-sealable closure is a zip-lock seal, a zipper, a hook and loop fastener, or any combination thereof.

In certain embodiments, the therapeutic device further includes a thermal element connected to the flexible enclosure for providing heat or cooling therapy to at least a portion of the wearer's body.

According to another aspect of the invention, a method for applying compression to a wearer's body is provided. The method includes at least the following steps: placing a portion of the wearer's body within a flexible enclosure thereby forming a cavity between an inner surface of the enclosure and the body; connecting a fluid evacuation pump in fluid communication with the cavity through a port extending through the flexible enclosure; and evacuating fluid from the cavity between the enclosure and wearer's body. As the fluid is evacuated, the flexible enclosure transition from a relaxed position to a compressed position, in which the inner surface of the enclosure exerts a compressive force against at least a portion of the body. Optionally, at least a portion of the flexible enclosure defines a cross sectional area, wherein the cross sectional area in the relaxed position is greater than the cross sectional area in the compressed position.

According to another aspect of the invention, a wearable compression garment is provided. The wearable compression garment includes a flexible enclosure formed from an elastomeric material configured to enclose at least a portion of a wearer's body thereby forming a cavity between the body and an inner surface of the enclosure. The garment also includes at least two ports extending through the flexible enclosure for accessing the cavity and configured to connect to a fluid evacuation pump. Each of the ports is transitionable from an open position, when the port is connected to the fluid evacuation pump, to a closed position, when the port is not connected to the fluid evacuation pump. Upon actuation of the pump, the flexible enclosure is configured to transition from a relaxed position to a compressed position, in which the inner surfaced of the flexible enclosure exerts a compression force against a portion of the wearer's body.

BRIEF DESCRIPTION OF THE DRAWINGS

Some of the advantages and features of the preferred embodiments of the invention have been summarized hereinabove. These embodiments, along with other potential embodiments of the device, will become apparent to those skilled in the art when referencing the following drawings in conjunction with the detailed descriptions as they relate to the figures.

DETAILED DESCRIPTION OF THE INVENTION

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

With reference to the figures, a therapeutic device, assembly, or system 10 for therapeutic pressure treatment is provided. For convenience, the individual wearing the system 10 will be referred to hereinafter as a patient 12, though it is understood that this system 10 may be used by medical facilities and hospitals, by occupational therapists in home care situations, by physical therapists during rehabilitation treatments, by fitness trainers at gyms and physical fitness centers, as well as by individuals for personal use at home. The system 10 may also be used at sports enhancement centers and other specialized athletic training facilities to complement athletic strength training programs, such as strength training programs for collegiate and professional athletes.

The system 10 exerts a consistent, strong pressure against certain body surfaces or against the patient's entire body. The pressure may be provided continually for a predetermined duration. Alternatively, the system 10 may be configured to apply a pulsating or variable pressure that approximates pressure applied during massage therapy.

The present inventor has recognized that exerting a strong pressure against a body tissue provides numerous benefits that contribute to overall improved health and well-being of the patient 12. More specifically, the patient's body reacts to applied compressive forces by actuating muscle tissues to counteract the applied pressure. These efforts to counteract applied pressure lead to improved muscle tone, function, and strength. Similarly, various internal organs are strengthened by the applied pressure. For example, pressure increases resistance in the patient's peripheral arteries. Cardiovascular health is improved as the heart is required to apply increased force to circulate blood through the contracted arteries. Additionally, pulmonary strength, lung capacity, diaphragm strength, and other muscles associated with breathing are also actuated in response to pressure applied to the chest cavity. Breathing functions are strengthened to counteract the applied pressure. Finally, a pulsating pressure force has been found to improve joint mobility and to reduce pain. Specifically, the variable or pulsating pressure creates a massage or stretching feeling in muscle tissue that improves joint mobility, releases tensed muscles, and increases blood flow to affected regions to reduce pain and encourage healing.

Figure 1:
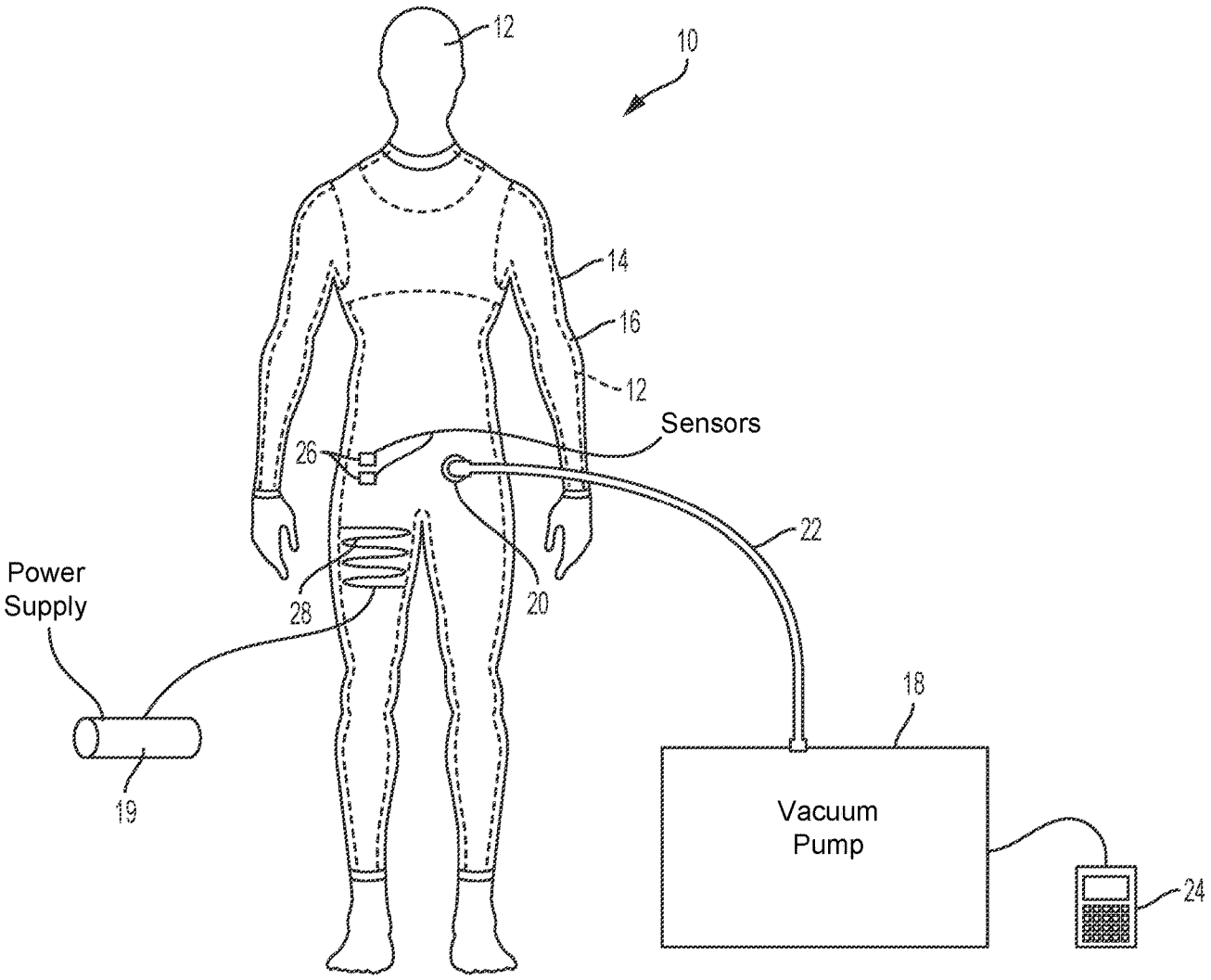
FIG. 1 is a schematic drawing of a system for therapeutic pressure treatment, according to the principles of the present invention.

With reference to FIG. 1, the system 10 includes a flexible enclosure 14 configured to cover or enclose at least a portion of the body of the patient 12. As will be described in greater detail hereinafter, the enclosure 14 could be a suit, sleeve, bandage, bag, or other suitable structure sized to receive a portion of the patient's body. The enclosure 14 is formed from a flexible material, such as polyurethane, vinyl, polychloroprene (e.g., neoprene), or natural rubber (polyisoprene). The material need not be completely airtight or impervious to airflow. However, desirably, the material is sufficiently airtight to form a low-pressure or negative-pressure cavity 16 between the enclosure 14 and the patient 12 when a fluid, such as air or water, is removed from the cavity 16. As a result of the negative-pressure cavity 16, the flexible enclosure 14 is pressed against the patient 12 by atmospheric pressure or, alternatively, by water pressure if the patient 12 is in a water body such as a pool or hot tub. The pressure causes the enclosure 14 to apply compression against the patient 12. It is noted that since the enclosure 14 need not be completely airtight, a pressure gradient may be created within the cavity 16 extending from the source of the negative-pressure (e.g a fluid evacuation pump) to the areas of the cavity 16 farthest from the source. Consequently, areas in the cavity 16 nearest to the source of the negative pressure will have a greater compression force than more distant areas. As a result of this pressure gradient, portions of the patient's 12 body that require treatment can be exposed to greater compressive force; areas that require less treatment can be exposed to a lower compression force.

In certain embodiments, the suction force is provided by a fluid evacuation pump, such as a vacuum pump 18. The vacuum pump 18 may be integrally formed with or attached to the flexible enclosure 14. Alternatively, the vacuum pump 18 may be separate from the enclosure and connected to a port 20 of the enclosure 14 via a common conduit 22, such as a flexible tube, hose, pipe, or similar structure for withdrawing fluid or air from the cavity 16. Desirably, the conduit 22 is removeably attached to the port 20 so that the connector 22 can be removed when not in use. For example, the connection between the port 20 and conduit 22 may be any sort of releasable connector or quick release mechanism, such as a luer lock, threaded connector, or snap fit connection. As will be described hereinafter, in embodiments of the enclosure 14 having multiple ports 20, the releasable connector allows a user to easily and quickly switch the conduit 22 between ports 20 during treatment. Being able to remove the conduit 22 makes it easier to transport or store the system 10 between uses. The vacuum pump 18 may be any suitable mechanical or electronic device for evacuating air from an enclosed chamber. Exemplary vacuum pumps 18 usable with the system 10 of the present invention, include, but are not limited to, a mechanical diaphragm, piston, rotary pump, plunger, or vane. A pneumatic pump, referred to as a venturi, may also be used within the scope of the present invention.

In certain preferred and non-limiting embodiments, the vacuum pump 18 is associated with and controlled by a controller 24 for turning the pump on and off based on the therapeutic needs of a particular patient 12. The controller 24 may be any sort of mechanical or electric switch, as is known in the art. For example, the controller 24 may be a binary or on/off type switch. In more complex embodiments, the controller 24 is an electrical device capable of providing varying the suction force provided by the vacuum pump 18. In that case, the controller 24 may be a dedicated electrical device configured for turning the pump 18 on and off and for varying pump 18 power. The controller 24 may also be an electronic device such as a smartphone, tabletPC, or computer running software for controlling the pump 18. In a simplest embodiment, the vacuum pump 18 operates continuously for the duration of a therapeutic treatment. The therapeutic treatment may be short duration (on the order of several minutes) to long duration (several hours). The controller 24 may also allow an operator to select between various vacuum pressure intensity levels. The operator can modify the intensity based on the area of the body being treated, size and strength of the patient 12, or a desired therapeutic result.

In a further embodiment of the system 10, the controller 24 operates the vacuum pump 18 in an auto-cycling fashion. In that case, the system 10 includes one or more pressure sensors 26. The sensors 26 may be placed at any convenient location in the system 10, including within the cavity 16, attached to the port 20 or connector 22, or within a portion of the pump 18. As shown in FIG. 1, in a preferred and non-limiting embodiment, the sensors 26 are positioned within the cavity 16 below the enclosure 14. The sensors 26 may be any sort of mechanical or electromechanical sensor for measuring the force between two surfaces. The sensors 26 measure pressure between the enclosure 14 and the patient 12. In certain embodiments, the controller 24 may be configured to turn the pump 18 on or off when the pressure drops below a predetermined level. The auto-cycling operation provides a pulsating pressure, alternating between instances of increased and decreased pressure. As used herein, the term "increased pressure" refers to increased suction between the enclosure 14 and patient 12. However, it is understood that to achieve such an increased pressure, the pressure within the cavity 16 must actually become more negative. The pulsating pressure effectively mimics the feeling of massage therapy in which pressure is selectively and intermittently applied to body tissue.

In certain embodiments, the system 10 further includes thermal elements 28 for hot or cold treatment. The thermal elements 28 may be integrally formed with the enclosure 14. For example, thermal elements 28 may be threaded within the flexible material that forms the enclosure 14. Alternatively, the thermal elements 28 may be placed on top of the flexible enclosure 14 so that thermal energy is transferred to the patient 12 through the enclosure 14. The thermal elements 28 may be flexible tubes or conduits configured to receive hot or cold fluids. The thermal elements 28 may be connected to a power supply 19, such as a battery or power outlet, for providing power for the coils or heating/cooling elements. Alternatively, the thermal elements 28 may be hot or cold compresses, such as ice packs, heating pads, and the like. In other embodiments, the system 10 may be used with a Jacuzzi or whirlpool having hot or cold water. In that case, the patient 12 wears the flexible enclosure 14 while sitting in the whirlpool. Accordingly, the patient 12 is exposed to thermal treatments in conjunction with the pressure applied by the therapeutic treatment system 10.

Figure 2:
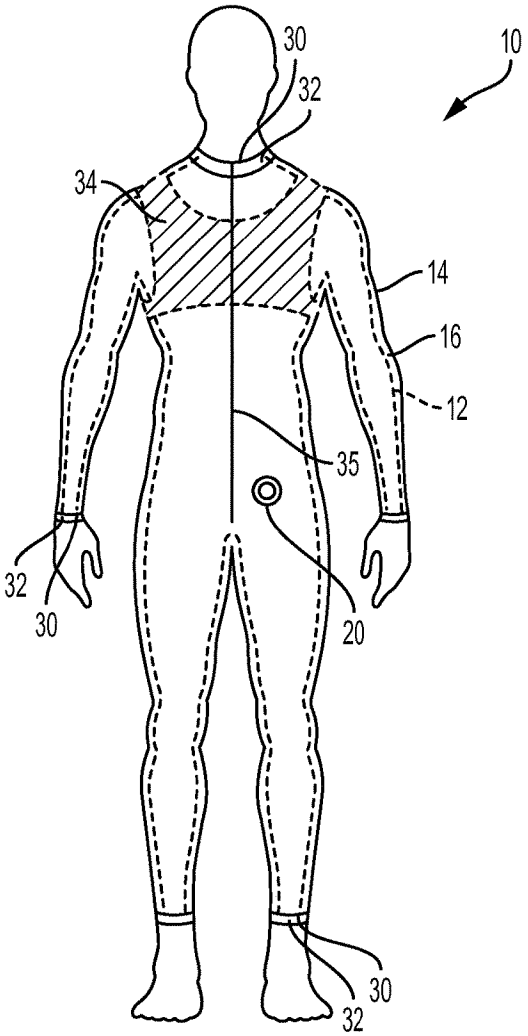
FIG. 2 is a schematic drawing of a flexible enclosure of the system of FIG. 1, according to an embodiment of the invention.

Having described elements of the system 10, the structure of various flexible enclosures 14 for use with the invented system will be described in detail. With reference to FIG. 2, the flexible enclosure 14 is a body suit. The enclosure 14 is similar in appearance to a wet suit. The suit may be a single garment or, alternatively, may be formed from separate pieces, such as a pair of pants and a separate shirt. The separate pieces may connect together with a fastener such as a zipper or elastic band (e.g. a waist band), so that a single cavity 16 is created beneath the pieces that make up the enclosure 14. Alternatively, the patient 12 may only wear a piece of the suit, such as pants or a shirt, if treatment is only needed in a more limited area of the patient's 12 body.

The enclosure 14 may also include openings 30 for the patient's hands, feet, and head. Alternatively, the patient 12 may wear elastomeric gloves or booties covering the hands and feet, respectively. The gloves and booties extend the cavity 16 around the patient's hands and feet for treatment of these extremities. For example, applying compression force to the hands may be beneficial for increasing muscle strength of fingers and for treatment of conditions, such as tendinitis or Carpal tunnel syndrome. Similarly, application of compression force to the feet may treat muscle weakness conditions, such as plantar fasciitis. The enclosure 14 may also include a hood partially enclosing the patient's 12 head for exerting pressure to specific areas of the head.

With continued reference to FIG. 2, any opening 30 of the enclosure 14 include a collar 32 that contracts to form a suitable seal between the enclosure 14 and the patient 12. The collar 32 may be positioned to prevent the enclosure 14 from moving along the patient's body when the pump 18 is engaged. The enclosure 14 further includes a slit 35, which allows a wearer (e.g., patient 12) to take the enclosure 14 on or off. The slit 35 may be held in a closed position with a zipper, a fabric hook and loop fastener (e.g., Velcro®) closure, or snaps. The enclosure 14 further includes the port 20 for connection with the vacuum pump 18 (shown in FIG. 1). An enclosure 14 in the form of a whole body suit is suitable for applying approximately equal pressure against all areas of the patient's body. Beneficially, application of consistent pressure across the entire body strengthens and improves function of numerous muscle systems simultaneously, which reduces treatment times compared with more target treatment methods.

It is recognized that certain portions of the body may not be able to withstand higher pressures. Therefore, the enclosure 14 may include one or more shields 34 for protecting various body regions. For example, the shield 34 may be placed about the cardio-thoracic region to protect the heart and lungs. Desirably, the shield 34 is a rigid frame inserted between the enclosure 14 and the patient 12, which prevents the enclosure 14 from compressing against the chest region of the patient. The shield 34 may also include a plurality of spacers or studs extending between the enclosure 14 and patient 12 for reducing contact with the chest region. Reducing pressure on the lungs makes breathing easier and prevents the patient 12 from becoming short of breath during treatment. Other body regions that may require a shield 34 during treatment with the system 10 include the stomach and diaphragm region of the torso. Similarly, if extremities such as hands and feet are enclosed in the cavity 16, portions of the fingers and toes may be covered with a shield 34 to prevent hyperextension or improper bending of such members.

Figure 3:
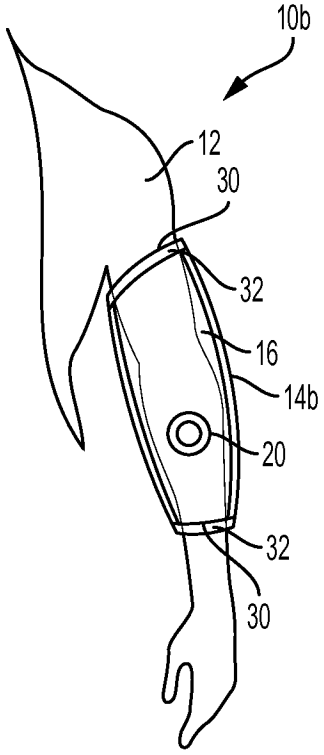
FIG. 3 is a schematic drawing of a flexible enclosure according to another embodiment of the invention.

With reference to FIG. 3, another embodiment of a system 10*b* having a flexible enclosure 14*b* is illustrated. The flexible enclosure 14*b* is a sleeve for targeted treatment of a specific body region. As shown in FIG. 3, the flexible enclosure 14*b* is a tubular sleeve having a collar 32 on each end thereof for forming the negative-pressure cavity 16 within the enclosure 14. The enclosure 14*b* also includes the vacuum port 20. The enclosure 14*b* can be pulled around a body region, such as an arm, shoulder, wrist, calf, or quadriceps, for treatment thereof. The enclosure 14*b* may be in the form of other garments such as shorts, pants, or a short sleeve shirt, depending on the type of treatment desired.

Figure 4:
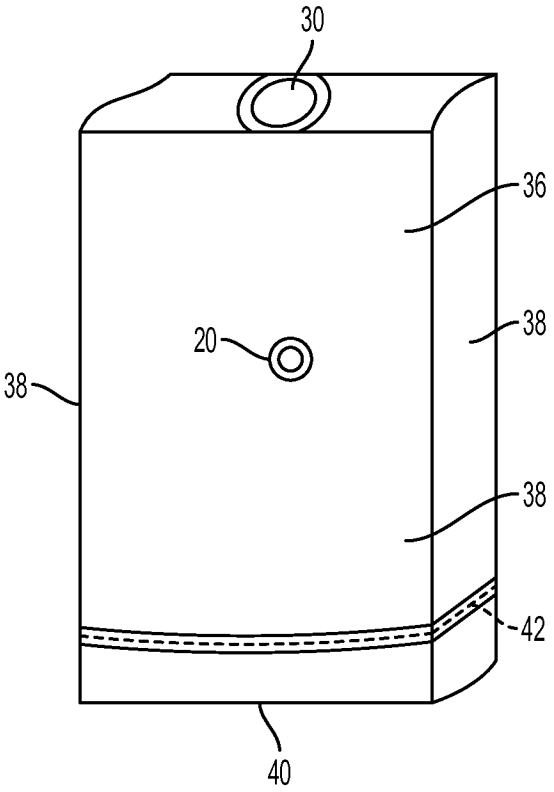
FIG. 4 is a schematic drawing of a flexible enclosure according to another embodiment of the invention.

With reference to FIG. 4, in a further embodiment, the enclosure is a vacuum bag 36. The vacuum bag 36 is a substantially rectangular bag 36 about seven (7) feet by three (3) feet. The vacuum bag 36 includes three sealed sides 38 and a re-sealable closure defining an opening 40. A second smaller opening 30 is positioned on one of the sealed sides 38, generally the side opposite the opening 40. The patient 12 is able to slip the smaller opening 30 over his or her head such that the bag 36 hangs around the patient's 12 shoulders. The opening 40 is then sealed by a common fastening means 42, such as a zipper, clip, snap, or other available fastener. The bag 36 may also include a zip-lock mechanism, as is used for zip-lock bags, for forming a suitable seal. The vacuum bag 36 also includes the vacuum port 20 for connection with the fluid evacuation pump 18 (shown in FIG. 1). As shown in FIG. 4, the vacuum bag 36 covers the patient's feet. The patient 12 may be required to wear shoes or other protective structures to prevent the vacuum bag 36 from exerting high force against the patient's toes or other areas of the foot which may be painful for some wearers.

Figure 5:
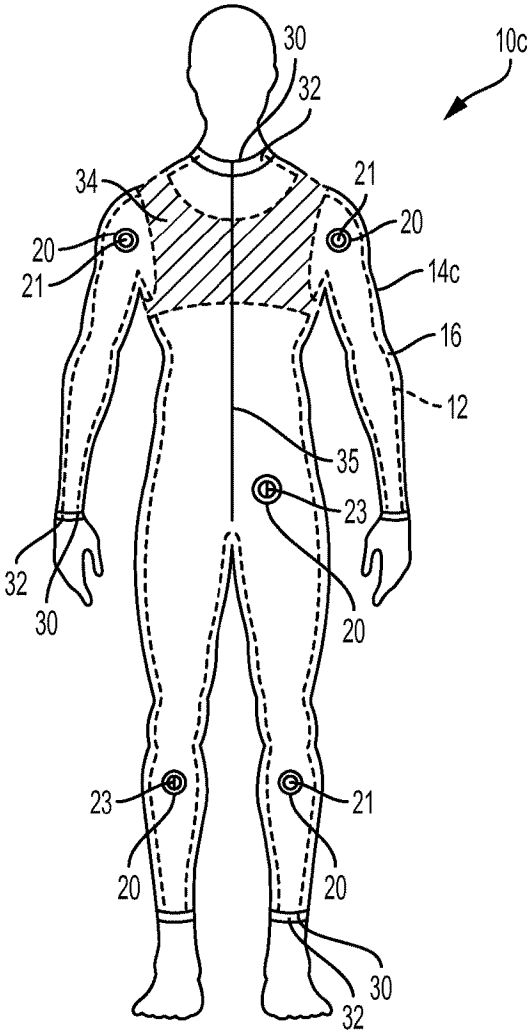
FIG. 5 is a schematic drawing of a flexible enclosure according to another embodiment of the invention.

With reference to FIG. 5, a further embodiment of a system 10*c* including a flexible enclosure 14*c* is illustrated. The enclosure 14*c* is generally similar in shape to the body suit depicted in FIGS. 1 and 2. The enclosure 14*c* may be a single garment or formed from a number of pieces (e.g. shirt, pants, gloves, and booties). As in previous embodiments, the enclosure 14*c* surrounds a cavity 16. However, unlike in previous embodiments, the enclosure 14*c* includes a plurality of vacuum ports 20. For example, a port 20 may be positioned on both arms and both legs of the enclosure 14*c*. A fifth port 20 may be positioned near the torso of the patient 12. Each port 20 is covered by either a cap 21 or check-valve 23 for preventing air from escaping from the cavity 16. The cap 21 and check-valve 23 are transitionable from an open position, when the port 20 is connected to a vacuum pump 18 (shown in FIG. 1), to a closed position, when the port 20 is not connected to the pump 18.

Including multiple ports 20 provides greater control over the level of pressure and compressive force exposed to different areas of the patient's 12 body. Particularly, as described above, a pressure gradient is created in the cavity 16 since the enclosure 14*c* is not completely airtight. In the embodiment of the enclosure 14*c* illustrated in FIG. 5, the port 20 nearest to the area of the patient's 12 body that requires treatment is connected to the pump 18. Other ports 20 remain in the closed position. Areas of the patient's 12 body nearest the port 20 connected to the pump 18 experience the highest compressive force and, as a result, the highest level of treatment. Other areas of the patient's 12 body that do not require treatment are exposed to reduced compressive force. Optionally, multiple ports 20 may be connected to the vacuum pump 18 at the same time, so that multiple areas of the cavity 16 have high compressive force. Similarly, different ports 20 could be connected to pumps 18 operating at different pressure levels, thereby providing even greater variation of the pressure gradient within the cavity 16.

With reference again to FIGS. 1-5, in use, the patient 12 begins by putting on the flexible enclosure 14, 14*b*, 14*c* or vacuum bag 36. For flexible enclosures 14, 14*c* that are shaped like clothing garments, the process for putting on the garment is substantially similar to putting on an article of clothing. It is noted, however, that, unlike various compression garments, as are known in the art, the flexible enclosure 14, 14*b*, 14*c* of the present invention is loose fitting and easy to put on. Specifically, since the enclosure 14, 14*c* is not yet under compression, the enclosure 14, 14*c* can hang loosely about the patient's 12 body. To enhance the seal around openings 30 of the flexible enclosure, 14, 14*b*, 14*c* the patient or an assistant may wrap tape (not shown) around the openings 30. Similarly, in cases in which the flexible enclosure 14, 14*b*, 14*c* is formed from multiple pieces (e.g., pants and a shirt), the user or an assistant may apply tape between the pieces of the enclosure 14, 14*b*, 14*c* to enhance the connection therebetween. The tape may be athletic tape, as is known in the art, which is easily removed from the patient's skin. The tape need not be completely airtight, but is sufficient for enhancing the seal and reducing airflow. For the vacuum bag 36 depicted in FIG. 4, the patient 12 slips his or her head through the opening 30. Once the patient 12 is in the bag 36, the patient 12 (or an operator, trainer, or other assistant) seals the open side 40 of the bag 36 with the fastening means 42.

Once the flexible enclosure 14, 14*b*, 14*c*, or vacuum bag 36 is sealed about the patient 12, the patient 12 (or an assistant) attaches the enclosure 14, 14*b*, 14*c* or vacuum bag 36 to the fluid evacuation pump 18 via the connector 22. The patient 12 or an assistant, may then manually turn on the fluid evacuation pump 18 to evacuate air or another fluid from the cavity 16. The pump 18 may also be automatically controlled by the controller 24. The pump 18 creates a negative pressure within the cavity 16. As a result of the negative pressure, the enclosure 14, 14*b*, 14*c* or vacuum bag 36 is forced against the surface of the patient's 12 body by a suction force. The enclosure 14, 14*b*, 14*c* or vacuum bag 36 exerts pressure against the surface of the patient's 12 body. In response to the applied pressure, the patient's 12 muscles contract. In addition, circulatory and pulmonary muscle systems may be required to exert greater force to compensate for the applied pressure. Additionally, the compressive force against body tissue increases circulation and blood flow. Further still, the pressure supports injured muscle tissues to encourage healing of injured or pulled tissues.

As the compressive pressure is being provided by the flexible enclosure 14, 14*b*, 14*c*, or vacuum bag 36, the patient 12 either remains in a stationary position or may perform a variety of physical activities or movements. Most simply, the patient 12 lies on his or her back on a bed or mat as treatment is being provided. The patient 12 may also sit in a body of water, such a hot tub or warm bath to combine heat and pressure treatments. Alternatively, the patient 12 may receive treatment from a physical therapist or physical trainer while the pressure is being provided to increase and/or supplement therapeutic benefits provided by the system 10, 10*b*, 10*c* alone. For example, the physical therapist may help stretch the patient's muscles or provide massage. In still other embodiments, the patient engages in physical activity or exercises while the compressive pressure is being provided. For example, the patient 12 may walk or run on a treadmill, swim in a pool, perform strength building and flexibility improving exercises such as Pilates or yoga, or may lift weights. In these cases, the system 10 can be used in combination with other physical training routines or devices to improve physical conditioning for athletes.

The pressure may be applied as a continuous force for the entire duration of the treatment. In that case, the wearer or user only needs to turn the pump 18 on at the beginning of the treatment and turn the pump 18 off after a predetermined period of time. Alternatively, the pressure could be applied in a cyclical or pulsating pattern in which pressure is turned on and off throughout the course of the treatment. Pulsating pressure provides a massage sensation in which the muscle tissue contracts (e.g., is exposed to pressure) and releases multiple times over the course of the treatment. It is believed that such pulsating pressure provides especially beneficial results which increase muscle activity and physiological benefits. The treatment is performed for a predetermined period of time, generally a few minutes, though certain treatments may last an hour or more.

Once the treatment is completed, air is introduced into the cavity 16 causing the enclosure 14, 14*b*, 14*c* or vacuum bag 36 to release from the body surface. Once the enclosure 14, 14*b*, 14*c* or vacuum bag 36 releases, the patient 12 (or assistant) removes the enclosure 14, 14*b*, 14*c* or vacuum bag 36. The treatment can be repeated several times during a single office visit to a doctor or physical therapist. Alternatively, a patient 12 may schedule a treatment every few weeks or once a month. Further still, in certain embodiments, the patient 12 may alternate between treatment and physical exercise. In that case, the strengthening and pain reducing effects of the therapeutic treatment may allow for greater physical exertion during exercise.

While several embodiments of the therapeutic devices, systems for compression treatment with vacuum pressure, and flexible enclosures for use with such systems are shown in the accompanying figures and described hereinabove in detail, other embodiments will be apparent to, and readily made by, those skilled in the art without departing from the scope and spirit of the invention. For example, it is to be understood that this disclosure contemplates that, to the extent possible, one or more features of any embodiment can be combined with one or more features of any other embodiment. Accordingly, the foregoing description is intended to be illustrative rather than restrictive.

The invention claimed is:

1. A therapeutic device for applying pressure to a portion of a wearer's body, the device comprising:

a flexible enclosure comprising a flexible material configured to enclose at least a portion of the wearer's body, thereby forming a cavity between an inner surface of the enclosure and the body;

at least one port extending through the flexible enclosure for accessing the cavity;

at least one shield comprising a rigid frame positioned between the inner surface of the flexible enclosure and the wearer's body configured to prevent a portion of the flexible enclosure from compressing against a portion of the wearer's body, the rigid frame comprising opposing arm openings and a neck opening positioned such that, when worn by the wearer, the rigid frame covers a cardiothoracic region of the wearer's body;

a fluid evacuation pump in fluid communication with the cavity through the at least one port; and a controller connected to the fluid evacuation pump configured to cause the fluid evacuation pump to generate a negative pressure within the cavity which causes the flexible enclosure to transition from a relaxed position to a compressed position, in which the flexible enclosure exerts a compression force against the wearer's body, wherein the compression force one or more of actuates muscle tissues of the wearer to counteract the compression force, massages muscle tissue of the wearer, increases resistance in peripheral arteries of the wearer, and increases force required to circulate blood through contracted arteries of the wearer.

2. The therapeutic device of claim 1, wherein at least a portion of the flexible enclosure defines a cross sectional area and wherein the cross sectional area in the relaxed position is greater than the cross sectional area in the compressed position.

3. The therapeutic device of claim 1, wherein the flexible enclosure comprises a body suit having a central portion configured to receive the wearer's torso and outer portions configured to receive the wearer's extremities.

4. The therapeutic device of claim 1, wherein the at least one port comprises a releasable connector configured to engage an end of a hose extending between the port and the pump, and wherein the releasable connector comprises one or more of a luer lock connector, a snap fit connector, a threaded connector, and a one-way valve.

5. The therapeutic device of claim 1, wherein the controller is configured to automatically actuate and automatically stop operation of the pump at predetermined intervals such that the compression force comprises a pulsating compression force.

6. The therapeutic device of claim 1, wherein the controller is configured to one or more of automatically increase and automatically decrease a suction force of the fluid evacuation pump according to an operating routine stored in computer readable memory associated with the controller at predetermined intervals, such that the compression force comprises a pulsating compression force.

7. The therapeutic device of claim 1, further comprising at least one sensor in communication with the controller configured to measure one or more of the compression force of the flexible enclosure against the wearer's body, a fluid pressure within the cavity, a flow rate of fluid being removed from the cavity, a physical parameter of the wearer, and any combination thereof.

8. The therapeutic device of claim 7, wherein the controller is configured to adjust a suction force of the pump based at least in part on information measured by the at least one sensor.

9. The therapeutic device of claim 1, wherein the controller is configured to repeatedly perform an operating routine a predetermined number of times, the routine comprising: activating the fluid evacuation pump, adjusting a suction force of the fluid evacuation pump, and stopping operation of the fluid evacuation pump.

10. The therapeutic device of claim 1, wherein the flexible enclosure further comprises at least one collar extending around a portion of the flexible enclosure for preventing the enclosure from sliding along the wearer's body as the flexible enclosure transitions from the relaxed position to the compressed position.

11. The therapeutic device of claim 1, further comprising a thermal element connected to the flexible enclosure for providing heat or cooling therapy to at least a portion of the wearer's body.

12. The therapeutic device of claim 1, further comprising at least a pressure sensor positioned between the flexible enclosure and the wearer's body configured to measure the compression force exerted against the wearer's body by the flexible enclosure.

13. A therapeutic device for applying pressure to a portion of a wearer's body, the device comprising:

a flexible enclosure comprising a flexible material configured to enclose at least a portion of the wearer's body, thereby forming a cavity between an inner surface of the enclosure and the body, wherein the flexible enclosure comprises a bag comprising a flat front surface, a flat rear surface, sides extending between the front surface and the rear surface, a closed bottom, a re-sealable open top comprising a closure for attaching the front surface to the rear surface, and at least an opening positioned on the closed bottom or sides of the bag sized such that a portion of the wearer's neck and head extend through the opening while other portions of the wearer's body are enclosed in the bag when the closure is sealed;

at least one port extending through the flexible enclosure for accessing the cavity;

a fluid evacuation pump in fluid communication with the cavity through the at least one port; and a controller connected to the fluid evacuation pump configured to cause the fluid evacuation pump to generate a negative pressure within the cavity which causes the flexible enclosure to transition from a relaxed position to a compressed position, in which the flexible enclosure exerts a compression force against the wearer's body, wherein the compression force one or more of actuates muscle tissues of the wearer to counteract the compression force, massages muscle tissue of the wearer, increases resistance in peripheral arteries of the wearer, and increases force required to circulate blood through contracted arteries of the wearer.

14. The therapeutic device of claim 13, wherein the closure comprises one or more of a zip-lock seal, a zipper, a hook and loop fastener, and any combination thereof.

15. A method for applying compression to a wearer's body comprising:

placing at least one shield comprising a rigid frame over a cardiothoracic region of a wearer's body, the rigid frame comprising opposing arm openings and a neck opening;

placing a portion of the wearer's body within a flexible enclosure thereby forming a cavity between an inner surface of the enclosure and the body, such that the at least one shield is positioned to prevent a portion of the flexible enclosure from compressing against the cardiothoracic region of the wearer's body;

connecting a fluid evacuation pump to the cavity through a port extending through the flexible enclosure; and evacuating fluid from the cavity between the enclosure and wearer's body, thereby causing the flexible enclosure to transition from a relaxed position to a compressed position, in which the inner surface of the enclosure exerts a compressive force against at least a portion of the body, wherein the compression force one or more of actuates muscle tissue of the wearer to counteract the compression force, massages muscle tissue of the wearer, increases resistance in peripheral arteries of the wearer, and increases force required to circulate blood through contracted arteries of the wearer.

16. The method of claim 15, wherein at least a portion of the flexible enclosure defines a cross sectional area and wherein the cross sectional area in the relaxed position is greater than the cross sectional area in the compressed position.

17. A wearable compression garment comprising:

a flexible enclosure formed from an elastomeric material configured to enclose at least a portion of a wearer's body thereby forming a cavity between the body and an inner surface of the enclosure;

at least one shield comprising a rigid frame positioned between the inner surface of the flexible enclosure and the wearer's body configured to prevent a portion of the flexible enclosure from compressing against a portion of the wearer's body, the rigid frame comprising opposing arm openings and a neck opening positioned such that, when worn by the wearer, the rigid frame covers a cardiothoracic region of the wearer's body; and at least two ports extending through the flexible enclosure for accessing the cavity and configured to connect to a fluid evacuation pump, wherein the at least two ports comprise a first port positioned to provide compression to the cardiothoracic region of the wearer's body and a second port positioned to provide compression to a second region of the wearer's body, wherein the first port and the second port are transitionable from an open position, when the first port or the second port is connected to the pump, to a closed position, when the first port or the second port is not connected to the pump, wherein, upon actuation of the pump, the flexible enclosure is configured to transition from a relaxed position to a compressed position, in which the inner surface of the flexible enclosure exerts a compression force against a portion of the wearer's body, and wherein the compression force one or more of actuates muscle tissue of the wearer to counteract the compression force, massages muscle tissue of the wearer, increases resistance in peripheral arteries of the wearer, and increases force required to circulate blood through contracted arteries of the wearer.

18. The wearable compression garment of claim 17, wherein the second region of the wearer's body comprises an abdomen region, a right shoulder region, a left shoulder region, head, right leg, left leg, right foot, or left foot of the wearer's body.

* * * * *